United States Patent [19]

Briones et al.

[11] Patent Number: 4,500,159

[45] Date of Patent: Feb. 19, 1985

[54] FILTER ELECTRICAL CONNECTOR

[75] Inventors: Francisco R. Briones, Markham; Kamal S. Boutros, Downsview, all of Canada

[73] Assignee: Allied Corporation, Morristown, N.J.

[21] Appl. No.: 528,290

[22] Filed: Aug. 31, 1983

[51] Int. Cl.[3] ..... H01R 13/648; H01R 13/66

[52] U.S. Cl. ..... 339/147 R; 339/143 R

[58] Field of Search ..... 339/143 R, 147 R; 333/181–185

[56] References Cited

U.S. PATENT DOCUMENTS

| | | | |
|---|---|---|---|
| 3,106,687 | 10/1963 | Bowman | 333/24 |
| 3,200,355 | 8/1965 | Dahlen | 333/79 |
| 3,897,125 | 7/1975 | Anderson | 339/143 R X |
| 4,126,840 | 11/1978 | Selvin | 333/79 |
| 4,202,594 | 5/1980 | Coleman | 339/147 |
| 4,215,326 | 7/1980 | Hollyday | 339/197 R X |
| 4,371,226 | 2/1983 | Brancaleone | 339/147 |
| 4,376,922 | 3/1983 | Muzslay | 333/182 |

*Primary Examiner*—Eugene F. Desmond

*Attorney, Agent, or Firm*—C. D. Lacina

[57] ABSTRACT

A filter connector (24; 90; 116) comprises an electrically conductive shell (60; 91; 118); a dielectric body (50; 93; 120) mounted to the shell and having a sidewall (52), a row of passages (56; 95; 123) extending therethrough with each receiving an electrical contact (51; 97; 124); and a row of separated cavities (58; 99; 122); extending inwardly from the sidewall in a direction transverse to that of the passages with each communicating with only one respective passage; a monolithic chip-type capacitor (80) including active and ground electrodes disposed in each cavity and contacting the contact; and a bias member (70; 100; 126) of electrically conductive material coupling each electrical contact and associated capacitor to the shell. One bias member embodiment comprises a separate comb-like member (70; 100) wherein a plurality of spring tines (74, 76; 104, 106) extend from a common flange (71, 102) with each spring tine having a portion contacting the shell and a knee portion (75; 105) engaging the ground electrode and biasing the active electrode of the capacitor inwardly against the contact, one application mounting the flange (71) to the dielectric body and another application mounting the flange (102) to the shell outer wall. Another bias member embodiment comprises a spring tine (126) having a medial knee portion (127) and a distal foot portion (128) integrally formed to its respective contact with the knee portion biasing the capacitor into contact with the shell and the foot portion into contact with the contact body. Further, separate and integrally formed bias members (110, 130) are provided for grounding mated connector shells.

23 Claims, 8 Drawing Figures

FILTER ELECTRICAL CONNECTOR

The present invention relates to a filter electrical connector.

Filter electrical connector assemblies utilizing a monolithic capacitor to filter electronic equipment from electromagnetic and radio frequency interference (RFI/EMI) are known. In connection with an electrical connector housing shown in U.S. Pat. No. 4,126,840 issuing Nov. 5, 1978 to Selvin, U.S. Pat. No. 4,371,226 issuing Feb. 1, 1983 to Brancaleone and U.S. Pat. No. 4,376,922 issuing Mar. 15, 1983 to Muzslay a single one-piece monolithic capacitor is mounted in a slot interposed between two rows of electrical contacts to simultaneously filter all of the electrical contacts. The electrical contacts in the Selvin patent are electrically connected to spaced lines of electrodes on the capacitor by soldering and thereafter the capacitor and contacts are encapsulated by a potting compound. Soldering and the use of a putty compound provides a lower reliability assembly, is largely non-repairable and requires a high degree of process control to produce. The aforementioned Brancelone and Muzslay connectors utilize a thin metallic plate wherein each of the active and ground electrodes of the capacitor are disposed on the same one plate. Because the capacitor plate is so delicate, a problem has developed that when one filter circuit has been ruined, the entire capacitor plate must be thrown away. Spring contacts shown in the art do not provide adequate ground inductance interference protection.

An object of the present invention is to provide a filter electrical connector utilizing monolithic capacitor technology and, in particular, chip-type capacitor filters which do not involve soldering and are not prone to damage during assembly and/or handling.

A filter electrical connector assembly comprises an electrically conductive shell, a dielectric body having front and rear faces and at least one row of separate passages extending between the faces, the body being disposed in the shell and each of the passages receiving an electrical contact, and means for filtering the electrical contacts from radio frequency interference.

In one embodiment according to the present invention, the insulator body includes a like plurality of cavities extending transverse to the axis of the passages and communicating with one respective passage, each cavity receiving a single discrete, monolithic chip-type capacitor therein for filtering the associated electrical contact, each capacitor comprising a dielectric substrate having a live and a ground electrode with the live electrode contacting the electrical contact and the ground electrode being electrically coupled to the shell.

Means for electrically coupling each associated pair of electrical contact and capacitor to the shell comprises an integral one-piece spring member of electrically conductive material comprising a flange including a plurality of spring tines with the flange being mounted to the insulator body and the spring tines extending from the flange, each spring tine interconnecting with one repective capacitor to bias the capacitor inwardly against the contact and the spring tine outwardly against the inner wall of the shell. In an alternate approach, the coupling means comprises a flexible spring tine of electrically conductive material extending from each respective electrical contact with the spring tine having a first portion intergrally connected to the contact and a second portion contacting the ground electrode and biasing the capacitor into contacting relation against the shell.

To reduce ground inductive interference, the distal end of the spring tines contact the conductive portion from which they extend.

To enhance grounding of mating connector shells, a spring element is provided on the forward mating end of one of the connector shells and includes a flexible spring element associated with the forward end of the one connector shell, the spring element being either separately provided or integrally formed from the shell itself.

In one particular embodiment, these aspects have been combined in an adaptor for protecting mating sets of electrical contacts carried by respective pairs of mating connector housings of known configuration to retro-fit the connector housings without reconstructing the internal workings of connectors in the field.

One way of carrying out the invention is described in detail below with reference to the drawings which illustrate specific embodiments of this invention, in which.

Figure 1:
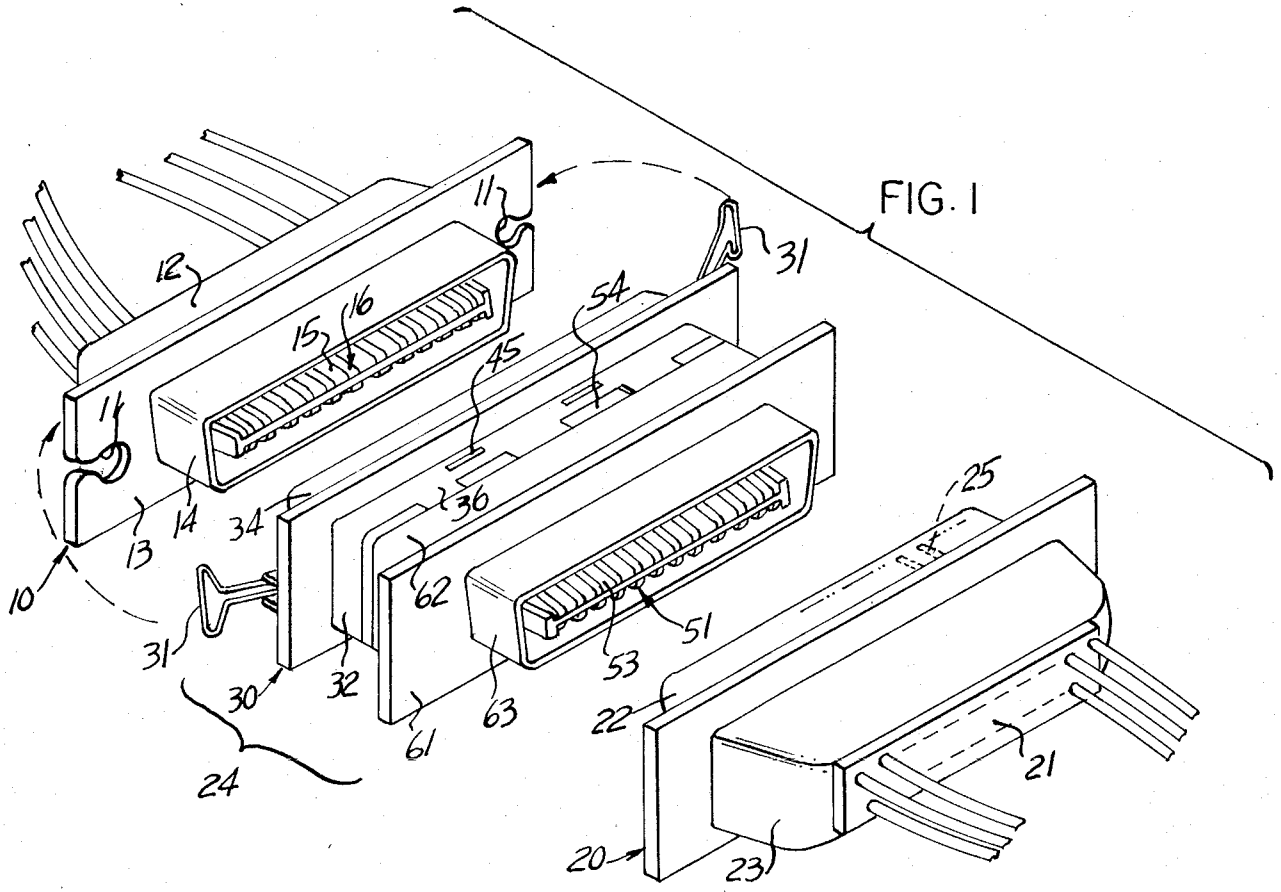
FIG. 1 is an exploded perspective view of a filter electrical connector assembly including an adaptor shown prior to assembly.
Figure 4:
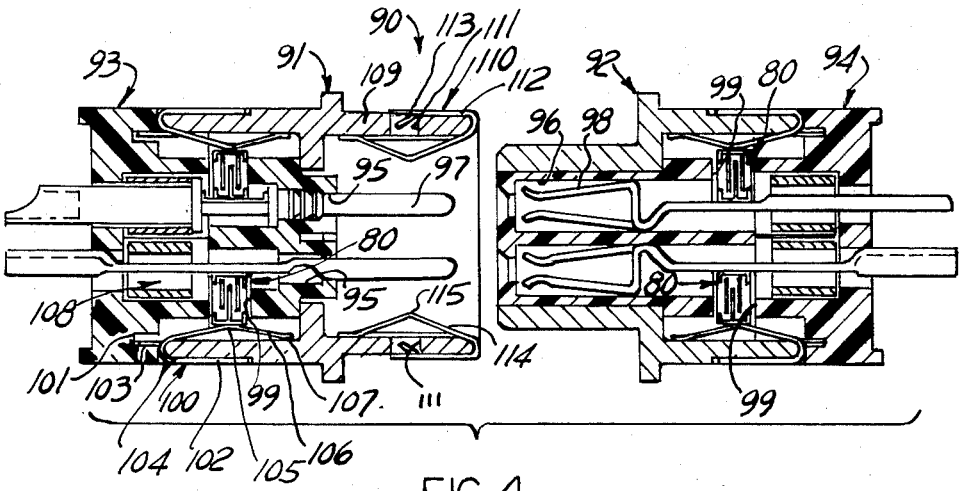
FIG. 4 is an side elevation view in section of an alternate embodiment of a filter electrical connector assembly.
Figure 6:
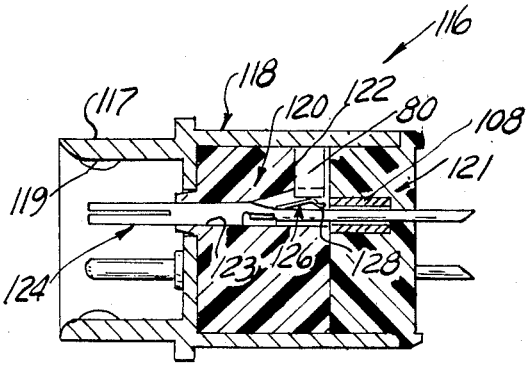
FIG. 6 is a side elevation view in section of an alternate embodiment of a filter electrical connector assembly.

Referring now to the drawings, FIGS. 1, 4 and 6 show filter electrical connector assemblies according to this invention.

FIG. 1 shows a filter electrical connector assembly as comprising mating first and second electrical connector housings 10, 20 carrying mating sets of electrical contacts 16, 25 and a filter electrical connector adaptor 24 for retro-fitting with and interconnecting the connector housings to filter the assembly and electrical contacts from radio frequency interference. Each of the connector housings are typically of electrically conductive material and each comprises, respectively, a forward mating end 14, 22, a rearward end 12, 23, a dielectric body 15, 21 mounted in the respective shell and the plurality of mating electrical contacts 16, 25 mounted in passages in each. Without adaptor 24, the forward ends 14, 22 and contacts 16, 25 will intermate with one another.

Figure 2:
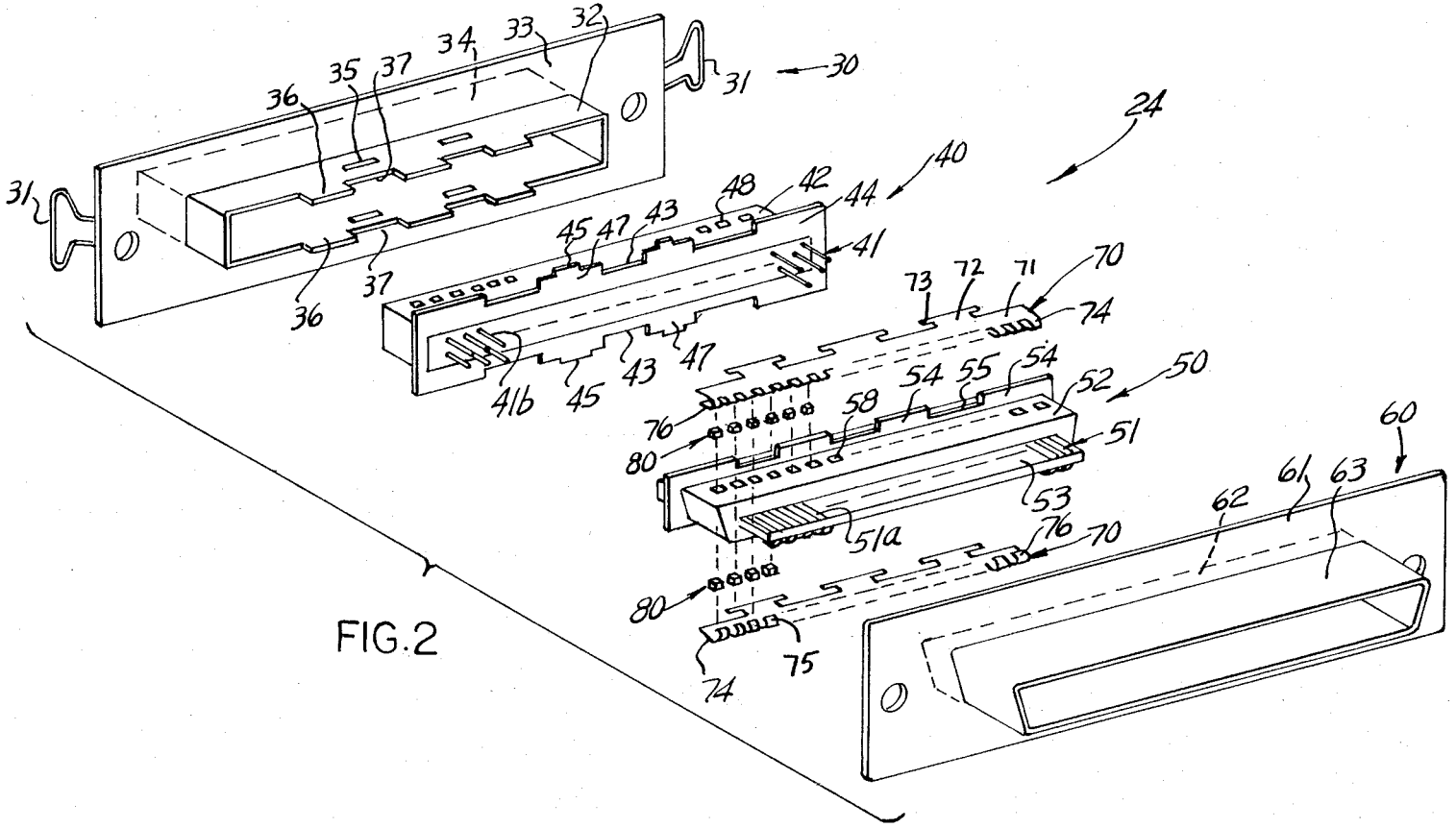
FIG. 2 is an exploded perspective view of the adaptor shown in the filter electrical connector assembly of FIG. 1.
Figure 3:
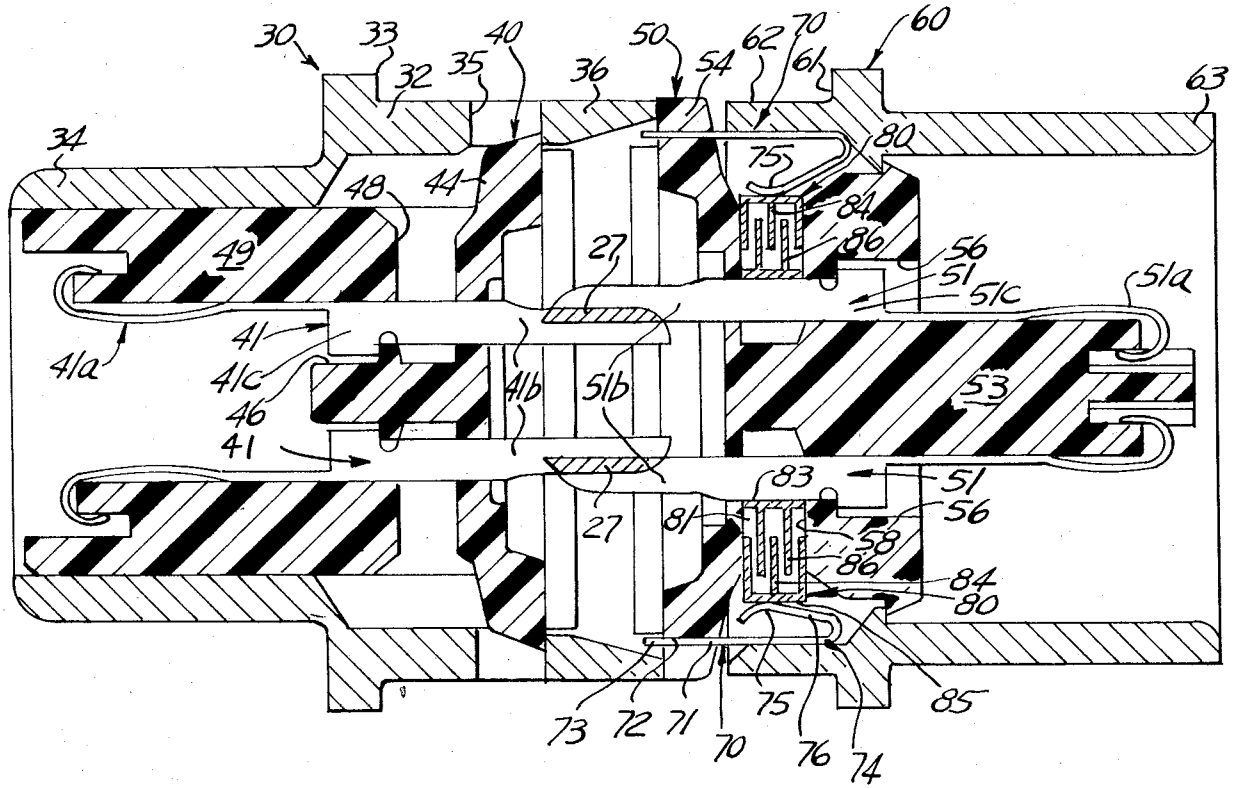
FIG. 3 is an side elevation view in section of the assembled filter electrical connector assembly of FIG. 1.

The filter connector adaptor 24, shown best in combination with FIGS. 2 and 3, comprises a shell 30, 60 of electrically conductive material, a dielectric body 40, 50 (or insulator) mounted in each shell, each of the respective dielectric bodies having a plurality of passages 46, 56 extending therethrough with each passage receiving an electrical contact 41, 51 therein and capacitor means for filtering the electrical contacts from RFI/EMI interference, the electrical contacts 41, 51 having, respectively, a rearward portion 41*b*, 51*b*, a forward portion 41*a*, 51*a* and a central portion 41*c*, 51*c*, the central portions for mounting the contacts in the passage of the dielectric body, the rearward portions 41*b*, 51*b* being interconnected by solder 27 and the forward portions 41*a*, 51*a* being adapted, respectively, to mate with the contacts 16, 25 in the first and second connector housing 10, 20.

To secure the filter connector adaptor 24 to the first connector housing 10, a flange 13 including spaced inlets 11 extends from the first connector housing and a pair of resilient latches 31 defining a T-shaped loop extend from the adapter, the latches being adapted to rotate inwardly and snap into the inlets 11 and seat the loop behind the flange 13.

FIG. 2 shows the filter connector adaptor 24 comprising a rear shell 30 having a rear insulator body 40, a front shell 60 having a front insulator body 50, the plurality of first electrical contacts 41 being mounted in the rear insulator body 40, and the plurality of second electrical contacts 51 being mounted in the front insulator body 50. Each of the insulator bodies 40, 50 includes, respectively, its plurality of passages 46, 56 extending therethrough, a sidewall 42, 52, and a plurality of cavities 48, 58 extending inwardly from the sidewall in communication with only one respective passage and transverse thereto. A plurality of monolithic chip-type capacitors 80 are adapted to be received in each cavity. Although cavities for receiving capacitors are shown in each insulator body, preferably the capacitors would be provided in only one set of cavities, such as those extending along sidewall 52 of the front insulator body 50.

A one-piece spring member 70 comprises a spring flange 71 and a plurality of spring tines 74, 76 extending therefrom, the spring flange including several tabs 72 having fingers 73 for mounting the spring member to insulator body 50, the spring tines including first and second portions 74, 76 with the first portion 74 extending from the spring flange and interconnecting the second portion 76 and the second portion being folded inwardly to be superposed by the first portion 74 and adapted to be received in one cavity. Preferably, the spring flange 71 and the spring tines 74, 76 would be integral and form a comb-like member.

The rear shell 30 includes a rear portion 34 and a front portion 32 with the front portion including turrets 36 having gaps 37 therebetween and a pair of openings 35 rearwardly of the turrets.

The rear insulator 40 includes sidewall 42, a flange 44 extending therearound and a pair of turrets 47 provided with a detent 45 and having gaps 43 therebetween. The sidewall 42 includes the plurality of separated cavities 48 communicating with the axial passages 46.

The front insulator 50 includes flange 54 extending therearound and including a pair of turrets 54 having gaps 55 therebetween, a support mating portion 53 for supporting the electrical contact portions 51*a* and the sidewall 52 with the plurality of separated cavities 58 communicating with the axial passages 56 extending therethrough.

The front shell 60 includes a front portion 62, a rear portion 63 and a flange 61 extending therearound.

FIG. 3 shows the rear and front shells 30, 60 and rear and front insulators 40, 50 when assemblied and the electrical contacts 41, 51 disposed in passages 46, 56 of the respective insulators 40, 50 with their rear portions 41*b*, 51*b* soldered at 27. The rear insulator 40 includes a support mating portion 49 for supporting the electrical contact portions 41*a*.

Capacitors 80 are shown in the cavities 58 of only one of the insulator bodies, here shown as the front insulator 50. Each capacitor 80 comprises a dielectric substrate 81 having live electrodes 86 and ground electrodes 84 disposed in parallel spaced relation and opposite inner and outer surfaces 83, 85 coated with a conductive material, the electrodes 84, 86 being disposed transversely to the axis of the passages 56 with the inner and outer surfaces of the capacitor contacting, respectively, the electrical contact 51 in the passage and the spring member 70.

Spring member 70, mounted to front insulator 50, includes the spring flange 71 being adjacent to the inner wall of shell 60, the spring tine having its first portion 74 contacting the inner wall of the shell and its second portion 76 reversely folded and including a V-shaped knee portion 75 contacting ground electrode 84 of the capacitor 80. To reduce ground inductance interference, the distal end of the second portion 76 would preferably extend downwardly into contacting relation with one of the spring flange 71 and first portions 74.

FIG. 4 shows a filter electrical connector assembly 90 comprising a pair of mating shells 91, 92, an insulator body 93, 94 mounted in each respective shell with each insulator body including a plurality of passages 95, 96 therein and each passage receiving an electrical contact 97, 98, the insulator bodies 93, 94 including a transverse cavity 99 for receiving therein one of the chip capacitors 80 as heretofore described.

A spring element 100 of electrically conductive material comprises a spring flange 102 having a tab 103 and a plurality of spring tines 104,106, the tab 103 being received in a recess 101 of the insulator 93 and flange 102 mounted against the outer wall of shell 91. The spring tines include a first portion 104 abutting the outer wall of shell 91 and a second portion 106 folded over and disposed in the shell, the second portion having a medial V-shaped knee portion 105 contacting the ground electrode of the capacitor and its distal end 107 contacting the inner wall of the shell, the spring element biasing the capacitor with its active electrode inwardly and against the electrical contact.

To provide for inductance, a ferrite sleeve 108 is disposed around selected of the electrical contacts.

Shell 91 includes a front portion 109 having an aperture 111 and the shell receives a ground spring 110, the ground spring having a first portion 112 abutting the outer wall of the shell and including a lance 113 disposed inwardly of aperture 111 to secure the ground spring thereto with a second portion 114 folded over and disposed inwardly of the shell, the second portion 114 including a medial V-shaped knee portion 115 adapted to bias against the other shell 92 when each are mated.

Figure 5:
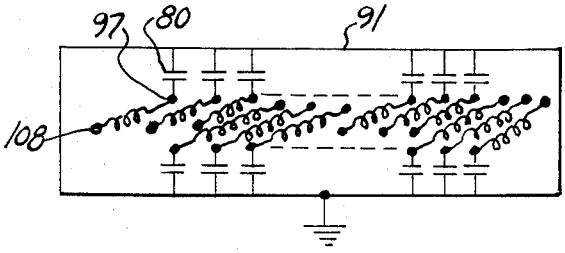
FIG. 5 is a view showing an equivalent electrical circuit of the assembly according to FIG. 4.

FIG. 5 is an equivalent electrical circuit of the filter electrical connector shown in FIG. 4 incorporating ferrite sleeve 108 to obtain an LC-circuit. If the ferrite sleeve 108 were eliminated, the equivalent circuit for the embodiment of FIGS. 1–3 would be the same but would be a C-circuit.

FIG. 6 shows an alternate embodiment of a filter connector assembly 116 according to the invention. The connector comprises a shell 118 of electrically conductive material, an insulator 120, 121 mounted in the shell, one insulator 120 having a plurality of cavities 122 therein, a plurality of passages 123 extending through the insulators, an electrical contact 124 mounted in the passages and a monolithic chip capacitor 80 mounted in each cavity and in electrical communication with the contact and the shell, contact 124 being a pin, a socket or other type of mateable contact. For purposes of illustration, both a pin and socket-type contact are shown disposed in the insulator body.

Figure 7:
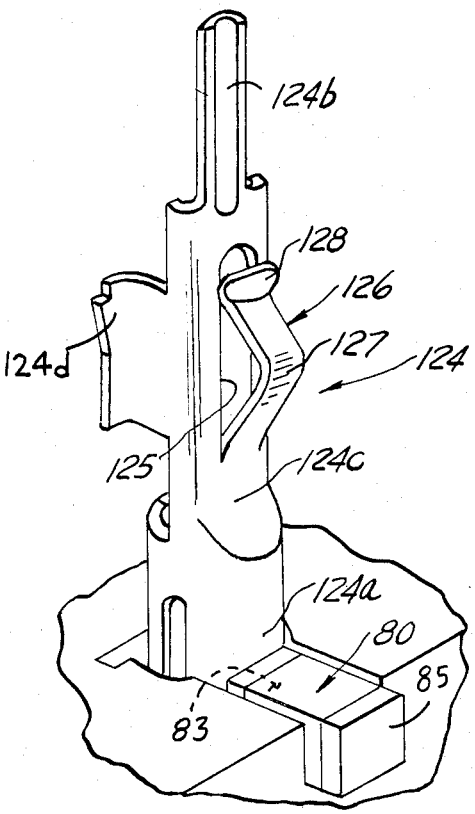
FIG. 7 is a perspective view of an electrical contact shown in the connector assembly of FIG. 6.

FIG. 7 shows that contact 124 includes a forward portion 124*a*, a rearward portion 124*b* and a central mounting portion 124*c*, the central mounting portion including a sharp barb 129 cooperative with the passage for interference fitting the electrical contact therein.

To reduce ground inductance interference the central mounting portion 124*c* includes a spring tine 126 stamped therefrom having a medial V-shaped knee portion 127 and a distal foot portion 128 adapted to contact the central mounting portion 124*c* as a result of the knee portion 127 biasing the capacitor 80 outwardly against the inner wall of shell 118.

For grounding shell 118 to its associated shell when mated, a forward portion 117 of shell 118 includes a pair of inward protuberances 119 to contact the mated shell.

Figure 8:
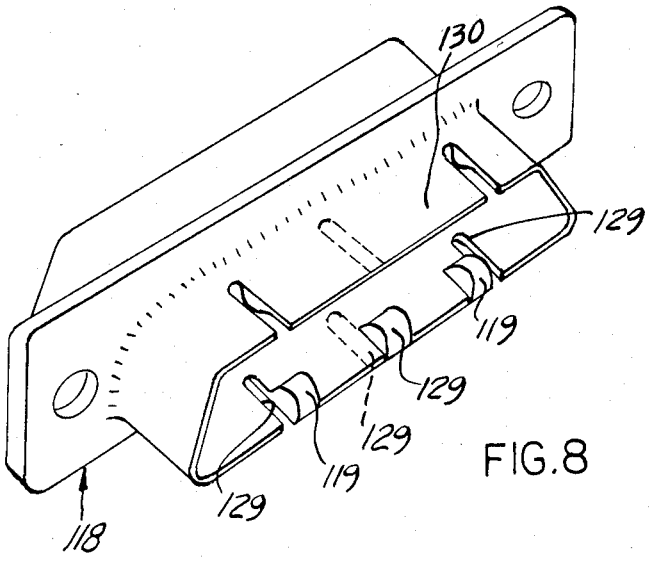
FIG. 8 is a perspective view of a connector shell shown in the connector assembly embodiment of FIG. 6.

FIG. 8 shows the shell of FIG. 7 as including a pair of slots 129 extending rearwardly from the forward end of forward portion 117 to define a flap 130 (i.e. elongated spring) which may flex upon mating. The dotted lines show a slot 129 to indicate that additional resilient flaps may be provided as necessary.

To assemble the filter connector adapter 24, the electrical contacts 41, 51 are mounted in their respective insulator body 40, 50 and the rearward ends 41*b*, 51*b* of electrical contacts 41, 51 then soldered. Capacitors 80 are inserted into the respective cavities 58 and the spring member 70 mounted to front insulator body 50, tabs 72 being fit between gaps 55 and fingers 73 seated behind turrets 54. Rear shell 30 is moved over rear insulator body 40 with turrets 36 fitting between gaps 43 and 55 whereby the tab 72 and fingers 73 are protectively covered and the spring member 70 secured against the front insulator body 50. Full insertion of insulator 40 into rear shell 30 results in detents 46 snapping and seating into aperture 35. Cam means operative on the front shell 60 and insulator 50 allow the front insulator body to be snapped behind and seated within the front shell.

We claim:

1. An electrical connector assembly including an electrically conductive shell, a dielectric body having front and rear faces and at least one row of separated passages extending between the faces, said body being disposed in said shell and each said passage receiving an electrical contact, and means for filtering said electrical contacts from radio frequency interference, said connector assembly characterized by:

said body including a plurality of separated cavities with each said cavity communicating with one respective passage;

said filter means comprising a discrete monolithic capacitor being received in each said cavity and disposed in contacting relation with the electrical contact disposed in the respective passage, said capacitor comprising a dielectric substrate having a live and a ground electrode with the live electrode contacting the electrical contact; and means for electrically coupling each said electrical contact and capacitor to said shell.

2. The invention as recited in claim 1 wherein said coupling means comprises a spring of electrically conductive material comprising a flange including a plurality of flexible spring tines, said flange being mounted on said body and said spring tines having a first portion and a second portion with said first portion extending from said flange to interconnect with said second portion, said second portion contacting said ground electrode and biasing said first portion into contacting relation against said shell.

3. The invention as recited in claim 2 wherein said spring tines are integrally formed to said flange and further including means for reducing ground inductance interference, said ground inductance interference reducing means comprising said second portion of the spring tine extending to a distal foot portion with said foot portion being biased into contacting relation against one of said second portion and said flange.

4. The invention as recited in claim 3 wherein said first and second portions are folded over one another and said second portion defines a V-shaped knee portion abutting the ground electrode.

5. The invention as recited in claim 1 wherein said coupling means comprises a flexible spring tine of electrically conductive material extending from each said electrical contact, said spring tine having a first portion connected to said contact and a second portion contacting said live electrode and biasing said capacitor into contacting relation against said shell.

6. The invention as recited in claim 5 wherein said second portion defines a V-shaped knee portion and extends to a distal foot portion and further including means for reducing ground inductance interference, said ground inductance interference reducing means comprising said knee portion contacting said live electrode and the foot portion being biased into contacting relation against the electrical contact.

7. The invention as recited in claim 1 further comprising a ferrite sleeve disposed around selected of said electrical contacts.

8. An adaptor for protecting mating sets of electrical contacts from RFI/EMI interference, said contacts being carried by a respective pair of mating connector housings of known configuration and said adaptor retro-fitting said connector housings, said adaptor comprising:

a shell of electrically conductive material having opposite mating ends, one and the other of said mating ends being adapted to mate, respectively, to one and the other of said electrical connector housings;

a body of dielectric material mounted in said shell, said body having a front face, a rear face and a row of axial passages extending between said faces, said front and rear faces being disposed adjacent, respectively, to said one and said other of the mating ends and each said axial passage receiving an electrical contact therein;

a plurality of individual, separated cavities disposed in said body, each said cavity communicating with only one of said axial passages;

a discrete monolithic capacitor received in each said cavity, said capacitor comprising a dielectric substrate having live and ground electrodes disposed in parallel, spaced relation with one said electrode contacting the electrical contact disposed in the passage and the other electrode facing the inner wall of said shell; and a one-piece spring member of electrically conductive material including a flange interconnecting with each of a plurality of separate resilient spring tines, said flange being mounted on said body and said spring tines making resilient electrical connection between the shell and said other electrode associated with the capacitor.

9. The invention as recited in claim 8 wherein said dielectric body is comprised of a front insulator having a sidewall and a rear insulator with each said front and rear insulator associating a like row of axial passages which extend therethrough, said cavities are disposed in said front insulator and each extends inwardly from the sidewall in a direction transverse to the axis of said passages, and including a plurality of associated first and second contacts, said first and second contacts being disposed, respectively, in a passage in each said front and rear insulator, each of said first and second electrical contacts having forward and rearward portions with the rearward portion of each associated first and second contact pair being electrically interconnected with one another and the forward portion of each being adapted to mate, respectively, with the mating sets of electrical contacts in said one and said other connector housings.

10. The invention as recited in claim 8 wherein a like plurality of transversely extending cavities are disposed in said rear insulator, each of the cavities in said rear insulator receive one said discrete monolithic capacitor, and a like one-piece spring member of electrically conductive material is mounted to the rear insulator, said spring member being mounted such that its spring tines electrically contact the capacitors in the rear insulator to thereby electrically interconnect the electrical contacts, capacitor and shell.

11. A filter connector assembly comprising:

an insulator body having front and rear faces, a sidewall, at least one row of passages extending between the faces and a like row of cavities extending inwardly from the sidewall with each cavity communicating with only one of said passages, each of said passages having its axis disposed in a direction transverse to that of its associated cavity and each said passage receiving an electrical contact therein;

a shell of electrically conductive material having an inner wall, said insulator body being mounted in said shell such that the inner wall of said shell is facing said row of cavities;

a discrete, monolithic, capacitor received in each said cavity, said capacitor comprising a dielectric substrate having a plurality of parallel, spaced, live and ground electrodes with one said electrode disposed in the direction of its respective electrical contact and the other said electrode disposed in the direction of the inner wall of said shell; and coupling means flexibly engaging each said capacitor for electrically coupling each said electrical contact with said shell.

12. The invention as recited in claim 11 wherein the one said electrode is the live electrode, the other said electrode is the ground electrode, said electrodes comprise spaced conductive plates disposed transversely of the passage axis, and each said capacitor includes first and second conductive surfaces with the first surface contacting the live electrode and the associated electrical contact and the second surface contacting the ground electrode and the inner wall of said shell.

13. The invention as recited in claim 11 wherein said coupling means is of electrically conductive material and comprises a spring flange having a plurality of separated spring tines extending therefrom and a tab portion mounted to said insulator body, each said spring tine including a knee portion biasing against the other said electrode to thereby bias said capacitor inwardly of its cavity and against its respective contact.

14. The invention as recited in claim 13 wherein each said spring tine includes a first and a second portion with each said first portion extending from the flange and interconnecting to its second portion and each said first portion is contacting the inner wall of said shell to thereby ground all ground electrodes in common to said shell.

15. The invention as recited in claim 14 wherein said respective first and second portions are superposing one another and said second portion includes the knee portion contacting the capacitor.

16. The invention as recited in claim 13 wherein each said spring tine includes a first and a second portion with each first portion extending from the flange and interconnecting to its second portion, said spring flange is mounted to the outer wall of said shell such that said first portion is contacting said outer wall and second portion is facing the inner wall of said shell, said second portion including the knee portion contacting and biasing the capacitor inwardly against the respective electrical contact.

17. The invention as recited in claim 11 wherein coupling means comprises a spring tine of electrically conductive material including a knee portion extending from said electrical contact, said knee portion contacting said capacitor and biasing the capacitor against the inner wall of said shell.

18. A filter connector assembly including a pair of mating shells of electrically conductive material carrying respective mating electrical contacts therein, comprising:

one said shell having an inner wall and a forward mating end;

an insulator body having row of axial passages extending therethrough, said body being mounted within the one said shell and each said passage receiving an electrical contact therein;

a plurality of separate, individual, cavities disposed in said insulator body, each said cavity being disposed in a direction transverse to the axis of said passages and each communicating with only one repective passage;

a monolithic capacitor disposed in each said cavity, each said capacitor comprising a dielectric substrate having a plurality of parallel, spaced, live and ground electrodes transverse to the axis of said passages, said live electrode being disposed in faced relation with said electrical contact and said ground electrode being disposed in faced relation with the inner wall of said one shell;

means for electrically coupling each said electrical contact and associated capacitor to the said one shell; and means for grounding the said one shell to the other mating shell.

19. The invention as recited in claim 18 wherein said grounding means comprises a one-piece spring element mounted to the forward mating end of said one shell, said spring element having a first portion secured to the outer wall of said one shell and a second portion facing the inner wall and including a knee portion contacting the other shell.

20. The invention as recited in claim 19 wherein said forward mating end includes an aperture and said first portion includes a lance extending therefrom and extending into said aperture to thereby secure said spring element to said forward mating end.

21. The invention as recited in claim 18 wherein said grounding means comprises the forward mating end of said one shell having a pair of slots extending axially rearward from the forward end of the shell to thereby define a flexible flap and the inner wall flap including a pair of bumps extending therefrom a distance sufficient to contact the other mating shell when mated.

22. The invention as recited in claim 18 wherein said electrical coupling means comprises a spring tine for biasing said capacitor inwardly of its cavity so that its active electrode and the associated electrical contact are abutting one another, said spring tine including first and second portions with said first portion contacting the shell and said second portion contacting the ground electrode.

23. In a filter connector assembly including an electrically conductive shell, a dielectric body having front and rear faces and at least one row of separated passages extending between the faces, said body being disposed in said shell and each said passage receiving an electrical contact, and means including a capacitor for filtering said electrical contacts from radio frequency interference, the improvement wherein said contact comprises;

a central mounting portion having forward and rearward portions extending therefrom, said central mounting portion including means cooperative with said passage for interference fitting the contact in the passage; and means cooperative with said filtering means for reducing ground inductance interference, said ground inductance interference reducing means comprising said central mounting portion having a flexible spring tine including a medial knee portion stamped therefrom, the spring tine extending outwardly and inwardly from the central portion with a distal portion of the spring tine including a foot portion for contacting said central mounting portion, the knee portion acting to bias the capacitor outwardly and the foot portion inwardly and against the central mounting portion.

* * * * *